United States Patent [19]

Hrebar

[11] 4,021,926

[45] * May 10, 1977

[54] SECONDARY SIDE MOUNTED GUNSIGHT AND ARRANGEMENT, FOR AUXILIARY USE WITH A PRIMARY TOP MOUNTED TELESCOPIC RIFLE SIGHT

[76] Inventor: Matthew James Hrebar, Box C, Beaverdale, Pa. 15921

[ * ] Notice: The portion of the term of this patent subsequent to June 8, 1993, has been disclaimed.

[22] Filed: Nov. 17, 1975

[21] Appl. No.: 632,680

Related U.S. Application Data

[63] Continuation-in-part of Ser. No. 550,424, Feb. 18, 1975, Pat. No. 3,961,423.

[52] U.S. Cl. ..... 33/258; 33/245; 33/261

[51] Int. Cl.[2] ..... F41G 1/02; F41G 1/16; F41G 1/38; F41G 11/00

[58] Field of Search ..... 33/233, 245, 246, 247, 33/248, 249, 250, 252, 254, 255, 256, 257, 258

[56] References Cited

UNITED STATES PATENTS

| | | | |
|---|---|---|---|
| 2,585,345 | 2/1952 | Procos | 33/252 |
| 2,629,933 | 3/1953 | Smith | 33/258 |
| 3,270,418 | 9/1966 | Simeone et al. | 33/258 |

*Primary Examiner*—Steven L. Stephan

[57] ABSTRACT

This invention is a secondary sighting system to supplement a primary telescopic sight on a rifle. It consists of a pair of sights, one front and one rear, which are offset to the side of the rifle bore, in a position which allows their instant use, should the primary telescopic sight become inoperable because of internal fogging, snow or rain covered lenses, target moving fast in thick brush, or target being too close to permit proper vision and sighting with scope magnification.

The front sight is a bead type, mounted on a support bar extending to the side from the gun barrel. The rear sight is an open notch type or a peep aperture, or both at one time, mounted on the side of the gun breech. This pair of sights permits a second line of sight aside from the telescope line of sight, parallel to the rifle bore.

2 Claims, 8 Drawing Figures

SECONDARY SIDE MOUNTED GUNSIGHT AND ARRANGEMENT, FOR AUXILIARY USE WITH A PRIMARY TOP MOUNTED TELESCOPIC RIFLE SIGHT

This application is a continuation-in-part of my copending application Ser. No. 550,424, filed Feb. 18, 1975, and now U.S. Pat. No. 3,961,423.

The matter included in this new application was presented to your office in two separate Amendments to Application No. 550,424 but was rejected by the Examiner as new matter.

The structures claimed in this new application perform the same functions as those claimed and allowed in the original Application No. 550-424. The new structures allow simpler adaptation to different models of rifles, and provide easier adjustment and greater stability.

The purpose of this invention is the same as that of my original invention: To provide a reliable and accurate second means of aiming a high powered rifle equipped with a top mounted primary telescopic sight, especially when the telescope has become inoperable because of mechanical difficulties such as scope damage, scope misalignment, internal fogging of lenses, and snow or rain-blurred external lenses; or because of physical difficulties to the shooter caused by too near and fast moving targets, or brush obscured targets.

These secondary sights do not interfere in any manner with the mounting of the primary top telescope sight. The telescope may be mounted directly over the rifle bore in a desirable low position close to the rifle barrel with the most stable mounting methods known. The telescope sighting and aiming efficiency is not impaired or affected in any way. At the same time these secondary sights allow accurate aiming of the rifle with peep or open sights at the choosing of the shooter.

SUMMARY OF THE INVENTION

This invention consists of front and rear sight assemblies.

The front sight assembly consists of a round threaded sighting element support standard flattened on one end, to which end the sighting point elements are attached. The threaded end is fastened to the side of the muzzle end of the rifle barrel by screwing into a threaded barrel clamp, or into a hole drilled and tapped into the side of a common front sight ramp, holding the sighting point elements in a position approximately one half of the rifle receiver width to the side of the rifle bore. The threaded sight element support standard may be screwed laterally in or out of the threaded barrel clamp or common front sight ramp to adjust the aiming line of sight for windage. The sight support standard is locked into the desired position with lock nuts.

The rear sight assemblies are of two types. One permits adjusting the rear sighting point for elevation by screwing the sight support standard up or down in a threaded mounting block. The other permits adjusting the rear sighting point for elevation by sliding the sight support standard up or down in a notched mounting block.

The screw type rear sight assembly consists of a threaded round vertical sight support standard which is drilled and tapped on one end to receive a threaded peep sight aperture which holds an open sight blade in position. The threaded vertical sight support standard is screwed into a mounting block fastened to the side of the rifle receiver. The rear sighting point elements are adjusted into proper elevation position by screwing the threaded vertical sight support standard up or down in the mounting block attached to the side of the rifle receiver. The sighting points are locked into the desired position with lock nuts on the threaded vertical sight support standard.

The slide type rear sight assembly consists of a plate vertical sight support standard drilled and tapped on one end to receive a threaded peep sight aperture having an open sight notch in its periphery. The vertical sight support standard fits into a notched mounting block fastened to the side of the rifle receiver. The rear sighting point elements are adjusted into proper elevation position by sliding the vertical sight support standard up or down in the mounting block notch. The sighting points are locked into the desired position with a set screw passing through the mounting block, pressing against the vertical sight support standard.

DETAILED DESCRIPTION

In the following detailed description of the invention, reference is made to the accompanying drawings: Like numerals refer to like parts.

Figure 1:
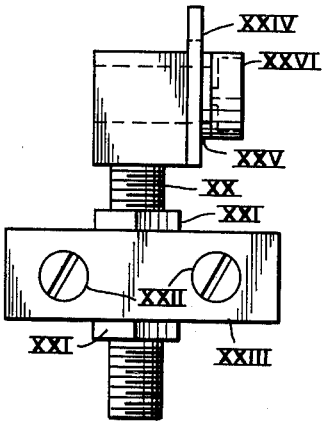
FIG. 1 is a side elevation of a complete screw type rear sight assembly having a threaded peep sight element holding an open sight blade in position.
Figure 2:
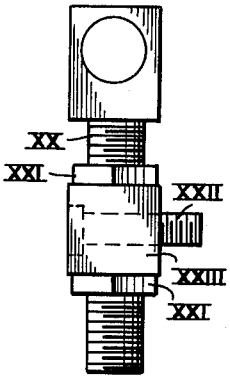
FIG. 2 is an end elevation thereof, omitting the peep and open sight elements.
Figure 3:
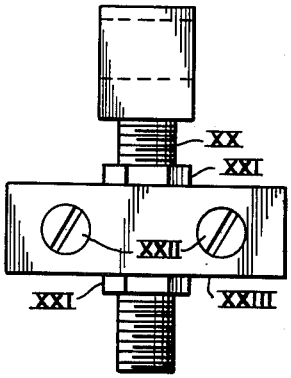
FIG. 3 is a side elevation thereof, omitting the peep and open sight elements.

The screw type rear sight assembly shown in FIGS. 1, 2, and 3 consists of a Mounting Block XXIII which fits against the side of the rifle receiver. The Block XXIII is drilled to receive Mounting Screws XXII which fasten Block XXIII to the side of the rifle receiver. The Mounting Block XXIII is drilled and tapped to receive the threaded vertical Sight Support Standard XX. The Sight Support Standard XX is drilled and tapped at the top end to receive the threaded Peep Sight Aperture Element XXVI which holds in position the center drilled Open Sight Blade XXIV, and secures it with Lock Washer XXV. The Sighting Elements XXIV and XXVI are placed in the desired elevation position by screwing the Sight Support Standard XX up or down in Block XXIII, and are locked in position by the Lock Nuts XXI.

Figure 7:
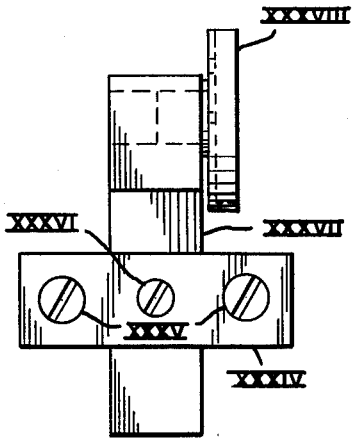
FIG. 7 is a side elevation of a complete slide type rear sight assembly having a combination peep and open sight element.
Figure 8:
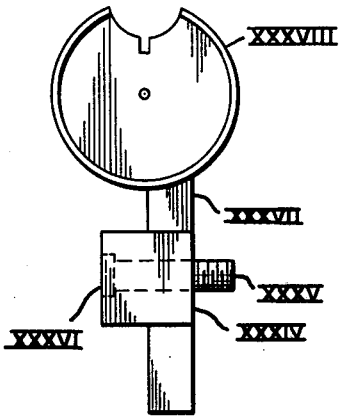
FIG. 8 is an end elevation thereof with the combination peep and open sight element detached and shown in brackets.

The slide type rear sight assembly shown in FIGS. 7 and 8 consists of a Mounting Block XXXIV which fits against the side of the rifle receiver. The Block XXXIV is drilled to receive the Mounting Screws XXXV which fasten Block XXXIV to the side of the rifle. Block XXXIV is notched in the center of the side facing the rifle receiver to receive the Vertical Sight Support Standard XXXVII. The Sight Support Standard XXXVII is drilled and tapped at the top end to receive the Combination Peep and Open Sight Element XXXVIII. The Sighting Element XXXVIII is placed in the desired elevation position by sliding the Sight Support Standard XXXVII up or down in the notched Mounting Block XXXIV. The Sight Support Standard is held in the desired position by Set Screw XXXVI which is threaded through Mounting Block XXXIV and presses against the Sight Support Standard XXXVII.

Figure 4:
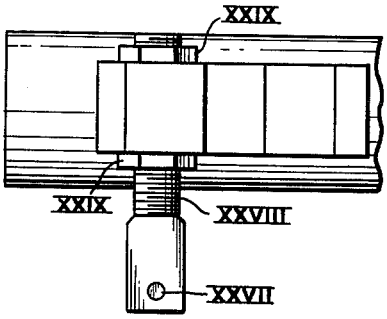
FIG. 4 is a plan view of a complete screw type front sight assembly attached near the muzzle end of a rifle barrel through the side of a common front sight ramp.
Figure 5:
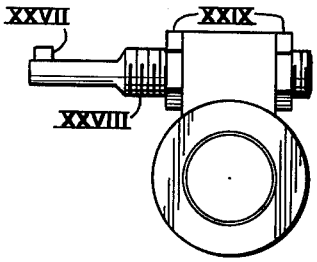
FIG. 5 is a rear elevation thereof.

The screw type front sight assembly mounted to the side of a common front sight ramp is shown in FIGS. 4 and 5. It consists of a Round Threaded Horizontal Sight Support Standard XXVIII which is flattened on one end. The flattened side is drilled and tapped to receive the Bead Type Sighting Element XXVII. The Horizontal Sight Support Standard XXVIII is screwed into a hole drilled and tapped into the side of the front sight ramp of the rifle, and locked into the desired windage position by Lock Nuts XXIX.

Figure 6:
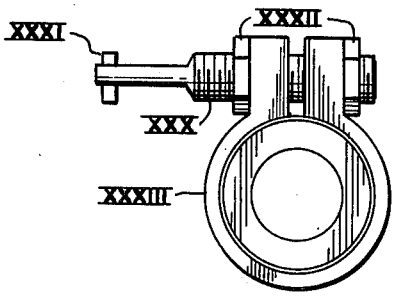
FIG. 6 is a rear elevation of a complete screw type front sight assembly attached near the muzzle end of a rifle barrel by means of a threaded barrel clamp.

The screw type front sight assembly mounted to the muzzle end of a rifle barrel by means of a barrel clamp is shown in FIG. 6. It consists of a Round Threaded Horizontal Sight Support Standard XXX which is flattened on one end. The flattened side is drilled and tapped to receive a bead type sighting element. FIG. 6 shows a Dual Type Bead XXXI which is used when both peep and open sighting is desired at one instance. The threaded end of the Sight Support Standard XXX is screwed into the threaded shoulders of Barrel Clamp XXXIII. The Sight Support Standard XXX is screwed in or out of the threaded shoulders of Clamp XXXIII for windage adjustment, and locked in the desired position with Lock Nuts XXXII.

I claim:

1. A gunsight comprising: a front sight assembly, said front sight assembly having support means including an elongated, round, threaded horizontal sight support standard flattened on one end and having bead sighting elements mounted on said one end, and a front sight ramp attached to the top front end of the gun barrel, said front sight ramp having a horizontal hole drilled and tapped there through to receive said round threaded horizontal sight support standard, said bead sighting elements extending to one side of said gun barrel, when said standard is received in said hole, said bead sighting elements being adjustable for windage by screwing said round threaded horizontal sight support standard into or out of the threaded hole in said front sight ramp; a rear sight assembly, said rear sight assembly support means including or elongated round threaded vertical sight support standard squared on one end and having open and peep aperture sighting elements attached thereto, and a mounting block for attachment to the side of the gun receiver, said mounting block having a vertical hole drilled and tapped there through to receive said round threaded vertical sight support standard thus holding said open and peep aperture sighting elements to one side of said gun receiver, when said vertical standard is received in said vertical hole, said open and peep aperture sighting elements being adjustable for elevation by screwing said round threaded vertical sight support standard up or down in the threaded vertical hole in said mounting block.

2. A gunsight comprising: a front sight assembly, said front sight assembly support means including an elongated round threaded horizontal sight support standard flattened on one end having bead sighting elements attached thereon, and a gun barrel clamp for supporting said round threaded horizontal sight support standard and attaching same firmly to the side of the gun, said gun barrel clamp having clamp shoulders and round holes through said clamp shoulders to receive said round threaded horizontal sight support standard, said standard being adjustable for windage by adjusting said standard into or out of said gun barrel clamp holes; a rear sight assembly, said rear sight assembly having support means including a vertical plate sight support standard drilled and tapped on one end, a combination peep sight plate having a peep aperture and an open notch sighting element in one edge of the sight plate, and a mounting block for attachment to the side of the gun receiver, said mounting block having a vertical notch to fit and hold the said vertical plate sight support standard and attached sighting element in a position to the side of the gun receiver, and being adjustable for elevation by vertical sliding adjustment of said vertical standard within said vertical notch.

* * * * *